12/17/85 XR 4,558,740 SR

United States Patent [19]

Yellig, Jr.

[11] Patent Number: 4,558,740

[45] Date of Patent: Dec. 17, 1985

[54] INJECTION OF STEAM AND SOLVENT FOR IMPROVED OIL RECOVERY

[75] Inventor: William F. Yellig, Jr., Tulsa Okla.

[73] Assignee: Standard Oil Company (now Amoco Corporation), Chicago, Ill.

[21] Appl. No.: 734,741

[22] Filed: May 14, 1985

Related U.S. Application Data

[63] Continuation of Ser. No. 499,060, May 27, 1983, now Defensive Publication No.

[51] Int. Cl.[4] ..... E21B 43/24

[52] U.S. Cl. ..... 166/272; 166/274; 166/303

[58] Field of Search ..... 166/272, 274, 303

[56] References Cited

U.S. PATENT DOCUMENTS

| | | | |
|---|---|---|---|
| 3,405,761 | 10/1968 | Parker | 166/303 |
| 3,620,304 | 11/1971 | Hearns et al. | 166/274 |
| 3,811,501 | 5/1974 | Burnett et al. | 166/274 |
| 3,847,224 | 11/1974 | Allen et al. | 166/274 |
| 3,954,139 | 5/1976 | Allen | 166/272 |

OTHER PUBLICATIONS

Hutchinson et al. "Phase Relations Of Miscible Displacement In Oil Recovery" A.I.C.H.E. Journal, Mar. 1961.

Yellig et al., "Determination and Prediction Of $CO_2$ Minimum Miscibility Pressures" J.P.T. 1980.

Rushing et al., "High Pressure $N_2$ Or Air Used For Miscible Displacement. . ." SPE Paper, 1977.

Yarborough et al., "Solvent and Driving Gas Compositions For Miscible Slug Displacement" SPE Journal, Sep. 1970.

*Primary Examiner*—Stephen J. Novosad
*Assistant Examiner*—Bruce M. Kisliuk
*Attorney, Agent, or Firm*—Robert R. Cochran

[57] ABSTRACT

The present invention is directed to a method of oil recovery wherein a miscibility-generating fluid and a reservoir-heating medium are injected into an oil-bearing formation for which it was heretofore believed miscibility could not be generated. By injecting the heating medium, such as steam, with a miscibility-generating fluid, the minimum miscibility pressure of the fluid is lowered and miscibility is effected at a reservoir pressure below the fracture pressure of the formation.

12 Claims, 6 Drawing Figures

EXPERIMENTAL SYSTEM

INJECTION OF STEAM AND SOLVENT FOR IMPROVED OIL RECOVERY

This application is a continuation of Ser. No. 499,060 filed May 27, 1983 now abandoned.

BACKGROUND OF THE INVENTION

Miscible displacement of hydrocarbons from underground reservoirs or formations has been known since at least 1950. Initially, it was suggested that natural gas could be used as an injection gas to effect miscible displacement, but with the current price structure for natural gas, it has become uneconomical for such use. Currently, $CO_2$ flooding is perceived as being a viable miscible displacement process, with a number of field-wide projects in the planning stage. More than 30 field trials of $CO_2$ injection processes have been undertaken to date. The largest application of $CO_2$ flooding currently in progress is the SACROC Unit, in a carbonate reservoir in the Kelly-Schneider Field in Texas, $CO_2$ floods have also been conducted in high temperature (240° F.), deep (10,000 to 13,000 ft) reservoirs, low temperature (less than 100° F.) reservoirs, high gas-saturation reservoirs, heavy oil reservoirs and low permeability reservoirs.

The use of steam has been shown to be effective for the recovery of very viscous hydrocarbons and conventional hydrocarbons. The enhanced recovery of the hydrocarbons is due to viscosity reduction with increasing temperature. It has heretofore been believed that the addition of a miscibility-generating fluid to steam would enhance hydrocarbon recovery by miscibly displacing oil mobilized by high temperature steam.

Conventional practice to date in actual field tests has been to employ only contact miscible solvent fluids with steam. These fluids are directly miscible with the mobilized oil at process conditions. These fluids, including such materials as naptha and LPG, tend to be very expensive.

Commercial scale miscible gas flooding currently contemplates utilizing gases which are not contact miscible but must develop miscibility in situ. These gases are referred to as multiple contact miscible (MCM) gases and include $CO_2$, nitrogen, flue gas, and dry hydrocarbon gases. Miscible displacement by MCM gases is generally limited to pressure greater than a certain minimum pressure defined as the minimum miscibility pressure (see Yellig, W. F. and Metcalfe, R. S., Determination and Prediction of $CO_2$ Minimum Miscibility Pressures, J. Pet. Tech, January 1980, p. 160–168). This mechanism of developing miscibility is utilized primarily in reservoirs having an average reservoir temperature less than about 200°–250° F., since as shown in FIG. 1, it has heretofore been believed that the minimum miscibility pressure (MMP; the minimum reservoir pressure at which miscible oil recovery will occur at a given temperature) increases above the fracture pressure of most reservoirs at temperatures above 250° F. It has been generally assumed that the relationship shown in FIG. 1 would continue with increasing temperature, so that as one increased the temperature of a hydrocarbon-bearing formation, the MMP would continue to increase significantly above the fracture pressure of most reservoirs, and either miscibility between injected gas and hydrocarbons would not be developed, or the formation would be fractured, in either case resulting in substantially reduced oil recovery. Therefore, previous additions of MCM gases (particularly $CO_2$) to steam have been primarily aimed at viscosity reduction or swelling effects.

Nitrogen has been proposed as a miscible fluid for oil recovery by, among others Rushing, et al., SPE Paper No. 6445, *High Pressure Nitrogen or Air May Be Used for Miscible Displacement in Deep-Hot Oil Reservoirs,* Deep Drilling and Production Symposium, Amarillo, Tex. Apr. 17–19, 1977. Its use under high pressure (2500–8000 psi) in deep hot reservoirs, was shown to displace from (62–92% of the original oil in place.

An apparent anomaly has existed in that the MMP for nitrogen has been observed to decrease with increasing temperatures at pressures commonly found in many reservoirs (see FIG. 3), under the same conditions which results in an increasing MMP for $CO_2$. This observation, in conjunction with binary critical point behavior, led to the conclusion by the inventor herein that the MMP of binary mixtures of MCM gases and hydrocarbons tend to increase over an increasing range of temperatures and thereafter tends to decrease as the temperature continues to increase. Therefore, it is now apparent that there are two temperatures at which an MCM gas is miscible with an oil at a given reservoir pressure.

SUMMARY OF THE INVENTION

The primary aim or objective of the present invention is to provide a process whereby miscible displacement of oil may be effected in reservoirs at pressures which heretofore would have prevented the generation of miscibility between injected fluids and formation oil. The present invention is used in an enhanced oil recovery operation in which a suitable miscibility-generating fluid is injected into a subterranean oil-bearing formation which has been heated to a temperature above the ambient formation temperature in order to displace oil to a production well for production of hydrocarbons therefrom.

The improvement in the recovery of hydrocarbons provided by the present invention makes use of a newly discovered phenomenon wherein, at a particular reservoir pressure, there are two temperatures at which a particular fluid becomes miscible with the formation oil. The significance of this is that heretofore it was believed that miscibility could only be generated at a relatively low pressure and temperature—the maximum pressure being dictated by the fracture pressure of the formation. Therefore, in many naturally "hot" reservoirs, it was believed that miscibility could not be generated because the necessary pressure was in excess of the formation fracture pressure.

However, I have discovered that by introducing steam into such reservoirs in conjunction with the miscibility generating fluid, miscible displacement is possible at an elevated temperature and at a pressure below the fracture pressure of the formation.

DETAILED DESCRIPTION OF THE INVENTION

Figure 1:
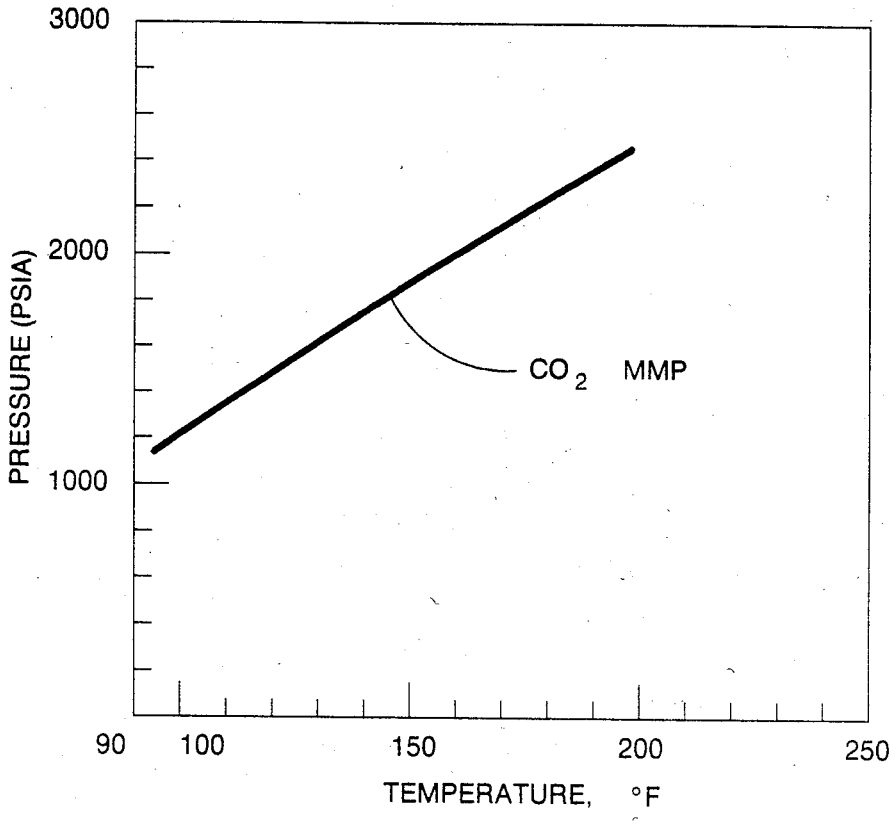
FIG. 1 is a graph representing the prior art perception of the relationship between reservoir pressure and temperature for determination of a fluid minimum miscibility pressure (MMP)

The minimum pressure requirement for generating miscibility between a fluid and in situ reservoir oil may be plotted as a function of temperature. At reservoir temperatures commonly encountered (i.e., less than 250° F.) in oil bearing reservoirs most miscibility-generating fluids exhibit an increasing "minimum miscibility pressure" (MMP) as the temperature increases within the range of reservoir temperatures, as shown in FIG. 1. As used hereinafter, and unless otherwise noted, the discussion of MMP will be directed toward $CO_2$ as the fluid; however it is to be understood that LPG, hydrocarbon gases, nitrogen and other fluids known to those skilled in the art, may likewise be utilized concurrent with or as a replacement for, $CO_2$. Likewise, while steam is described as the preferred formation-heating medium, any manner in which the hydrocarbon bearing formation can be heated will be acceptable in the present invention, so long as no adverse effects with the miscibility-generating fluid are noted.

Because of the relationship between pressure and temperature in developing miscibility as shown in FIGS. 1, it has heretofore been believed that the processes of reservoir temperature enhancement, such as by steam injection for reducing viscosity, and fluid injection for developing miscibility, were mutually exclusive; extrapolating the curve of MMP in FIG. 1 outwardly, a reservoir undergoing steam injection would have an MMP substantially above the fracture pressure of most reservoirs and therefore miscibility could not be developed without damaging the reservoir.

Figure 2:
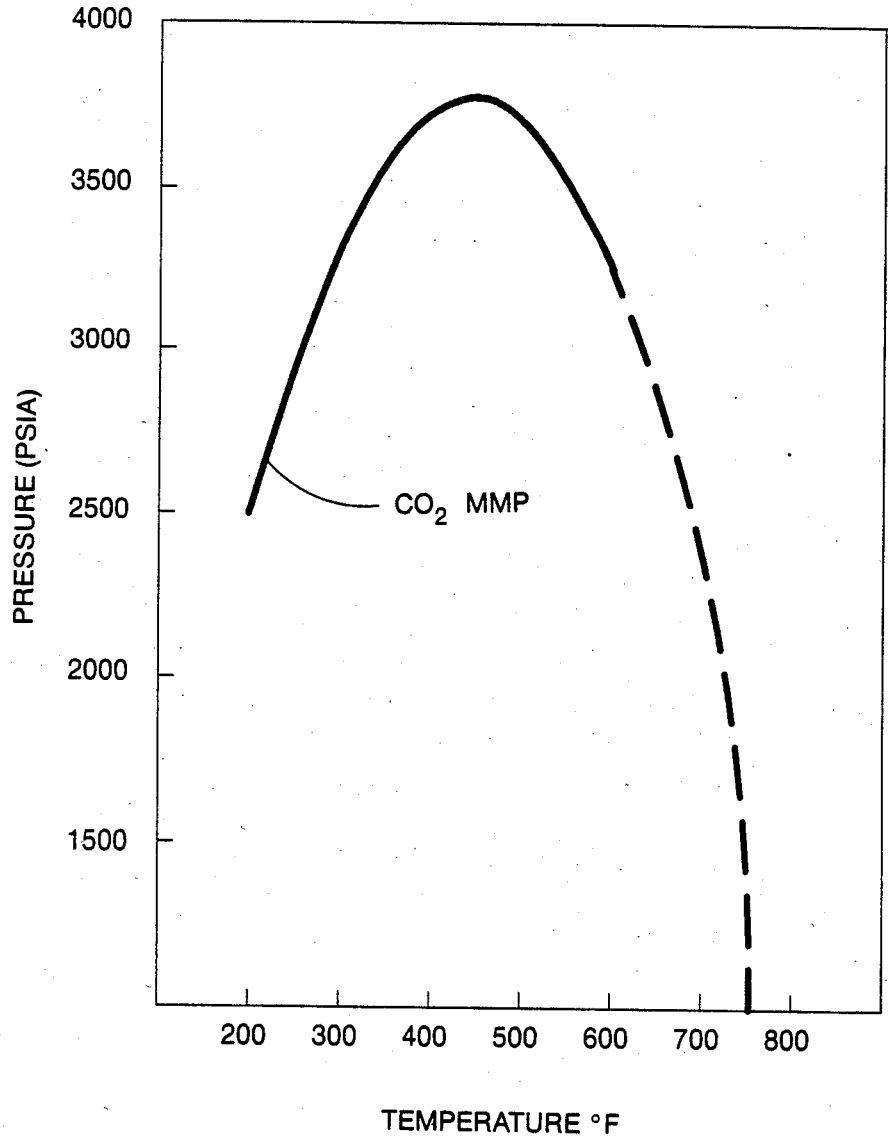
FIG. 2 is a graph representing the relationship of pressure and temperature for determination of a fluid MMP.
Figure 3:
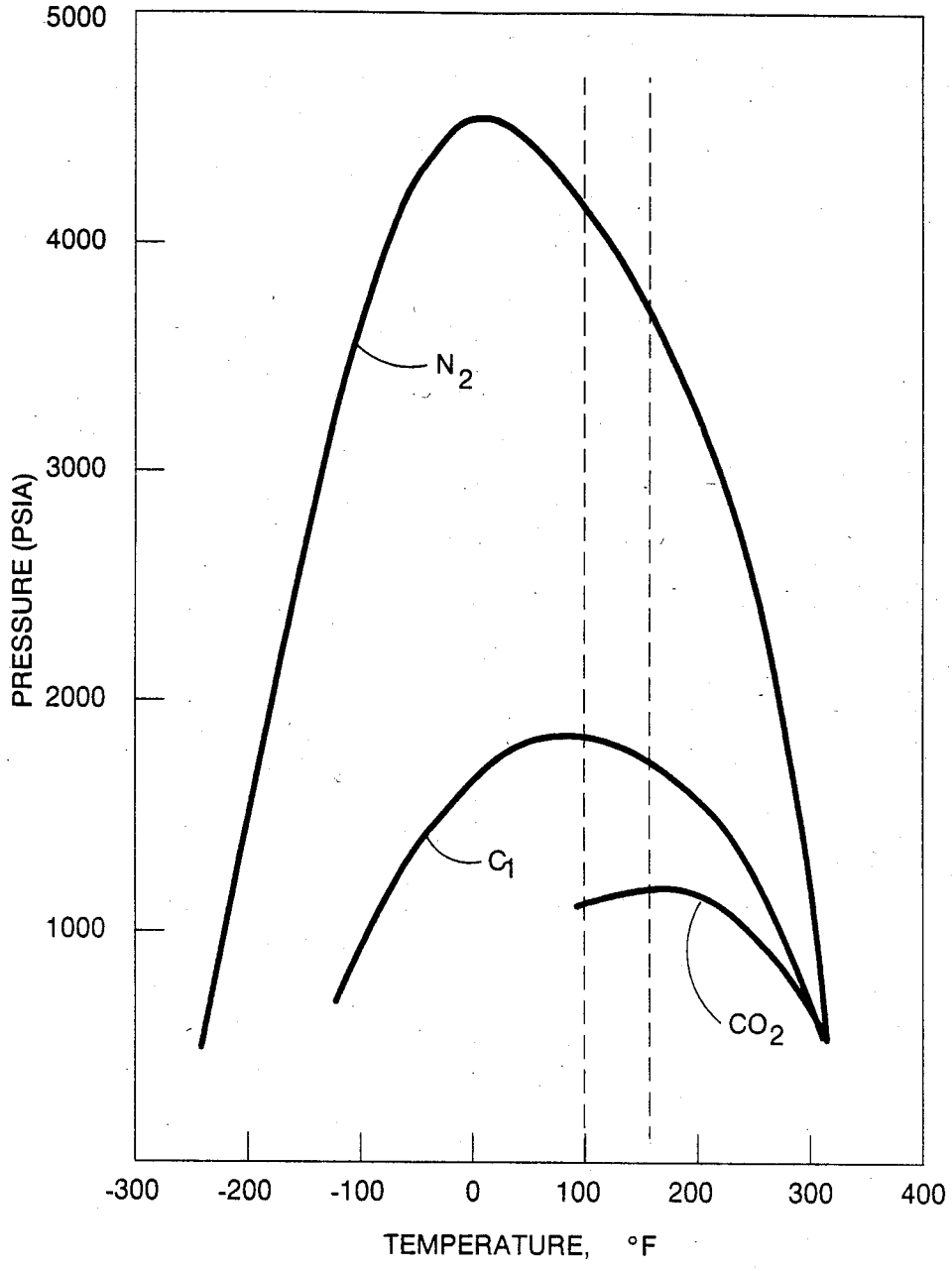
FIG. 3 is a graph representing the MMP curves of three fluids under reservoir conditions of pressure and temperature.

However, I have discovered that there are two temperatures at which $CO_2$ and a particular hydrocarbon will develop miscibility at a given pressure. As shown qualitatively in FIG. 2, the MMP for a $CO_2$-hydrocarbon binary mixture increases with increasing temperature, reaches a maximum pressure and then decreases with increasing temperature. This is consistent with phase equilibria and theories of miscibility development. The analysis of Hutchinson, L. A. and Braun, P. H. (Phase Relations of Miscible Displacement in Oil Recovery, AIChE J. (1961), 7, 64) shows that the minimum miscibility pressure should be the minimum pressure at which a critical composition is formed in situ. The general behavior of three binary mixture criticals is shown in FIG. 3. Based on the analysis of Hutchinson and Braun, MMP should exhibit behavior similar to critical pressure behavior as temperature is increased. The binary critical behavior of nitrogen-hydrocarbon systems and methane-hydrocarbon systems are similar to that of $CO_2$-hydrocarbon systems, but shifted higher in pressure and lower in temperature than $CO_2$. This phenomenon explains the apparent anomaly that exists when one increases reservoir temperature from 100° to 150° F., thereby resulting in a decrease in MMP for nitrogen and an increase in MMP for $CO_2$, as shown in FIG. 3.

This behavior allows one to use a combination of steam and MCM gas to achieve a miscible displacment process in a reservoir environment not otherwise conducive to miscible displacement without resulting in reservoir damage. Examples of these processes would be: steam-nitrogen miscible displacement of conventional oils at practical pressures; steam-$CO_2$ miscible displacement of heavy oils; steam-dry hydrocarbon gas or flue gas miscible displacement of conventional oils at practical pressures. The specific injection stream composition and conditions could be readily determined by those skilled in the art, using the experimental techniques outlined by Yellig and Metcalfe.

EXAMPLES

The $CO_2$ MMP's noted in this Example are determined using the sand-packed coil or slim-tube test apparatus as described in Yarborough, L. and Smith, L. R., *Fluid and Driving Gas Composition for Miscible Slug Displacement, Soc. Pet. Eng., J., September* 1970, p. 298–310, and Yellig and Metcalfe, supra. These test procedures are known to those skilled in the art and can be contracted by various service companies.

The experimental system is specially designed and constructed to allow operation at 500° F. and 5000 psia. The system is shown schematically in FIG. 6. The sand packed coil consists of a 0.5 in. OD stainless tubing 45 ft long which was filled with 150–200 mesh sand. This is wound up into an 18 in diameter coil. The pore volume of the coil is approximately 320 cc's and the permeability is approximately 4.25 darcies. The purpose of using a sand packed coil is to provide a medium for mixing $CO_2$ in oil in a flowing, multiple-contact process. It is not intended to simulate reservoir rock. Coil test data, especially from immiscible tests, should not be considered as readily indicative of the ultimate recovery, sweep, transition zone length, etc., to be achieved on a reservoir scale for actual oil reservoirs. Displacement tests in this coil are used to study the overall multiple-contact mass transfer of the test-oil system. Data from these tests are used only to distinguish miscible from immiscible displacements. Therefore, the $CO_2$ MMP determined herein using the sand-packed coil is the minimum pressure at which $CO_2$ could generate miscibility with the test oil through a multiple-contact process.

For each displacement test, the coil is saturated initially with oil at the desired test temperature and pressure. The $CO_2$ supply cylinder then is filled with 150 $cm^3$ of 99% pure $CO_2$ and allowed to equilibrate at test pressure. The $CO_2$ from the supply cylinder is injected into the coil at the rate of 3.6 $cm^3$/hour using a positive displacement pump.

The final oil recovery at 1.2 PV of $CO_2$ injected is determined by two different methods, which are used to give relative recoveries at different pressures to be used as a criteria for determining miscibility. The first method consists of measuring the volume of oil displaced during the test. This is calculated by multiplying the produced separator liquid volume by a predetermined volume factor. The volume factor is obtained separately by flashing 50 $cm^3$ of test oil to atmospheric conditions and determining the remaining liquid volume. The volume factor is determined as the ratio of the original volume to the final volume. Final recovery is then calculated by $$\% \text{ recovery} = \frac{(\text{separator liquid volume}) \times VF}{PV} \times 100$$

where VF=volume factor and PV=pore volume

The final recovery is also obtained by determining the amount of residual oil left in the coil. After terminating $CO_2$ injection, approximately 1.5 PV of an aromatic fluid is injected into the coil, and the total effluent is collected. The amount of separator oil in the effluent is determined by boiling off the fluid. This residual separator oil volume is multiplied by the volume factor discussed above to obtain the residual oil volume in the coil. The final recovery is then calculated by $$\% \text{ recovery} = \frac{PV - \text{residual oil volume} \times VF}{PV} \times 100$$

A typical comparison of the final recovery obtained from any given test by these different methods and comparison of the final recoveries for a replicate test are given in Yellig and Metcalfe, supra, which is hereby incorporated by reference in its entirety.

Figure 6:
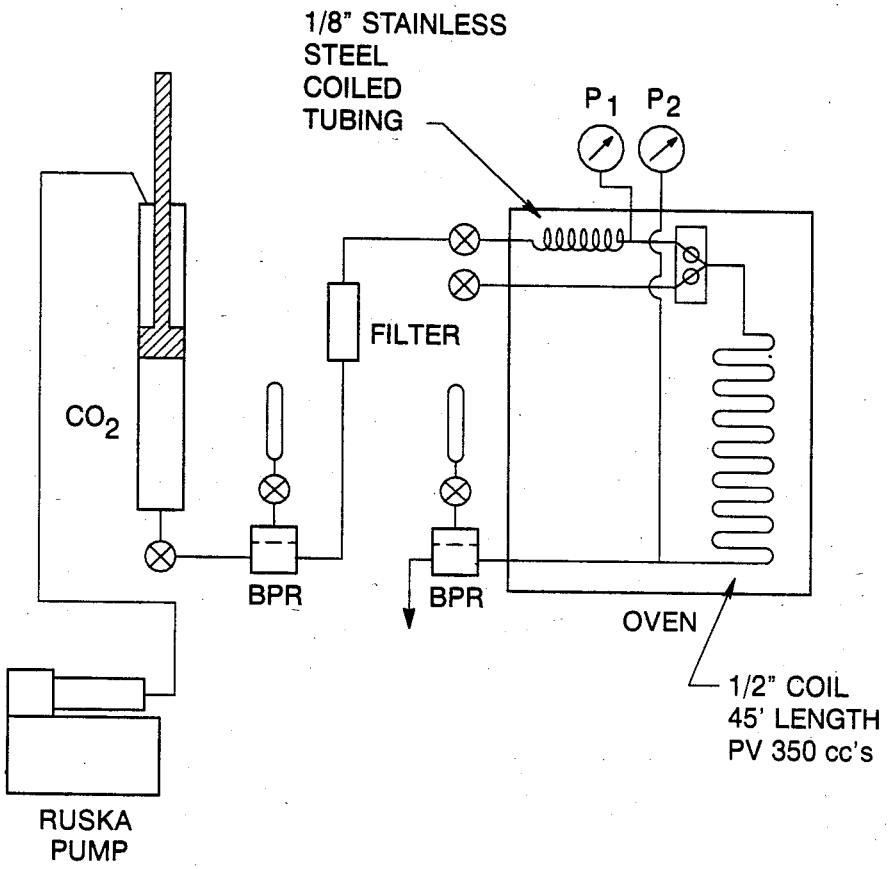
FIG. 6 is a schematic diagram of the test apparatus described herein.

When this procedure was reported in Yellig and Metcalfe in 1980, it was originally assumed that, as reported in FIG. 6 therein, an increase in reservoir temperature would require an ever-increasing $CO_2$ MMP. Therefore, in relatively hot reservoirs, or in shallow reservoirs of unconsolidated sand, in order to obtain miscibility with $CO_2$ one would need a reservoir pressure above the fracture pressure of the formation. Extrapolating the graph of MMP in FIG. 6 of Yellig and Metcalfe outwardly to 400° F., a reservoir pressure of approximately 5000 psig would be required for generation of miscibility between reservoir oil and injected $CO_2$.

Figure 4:
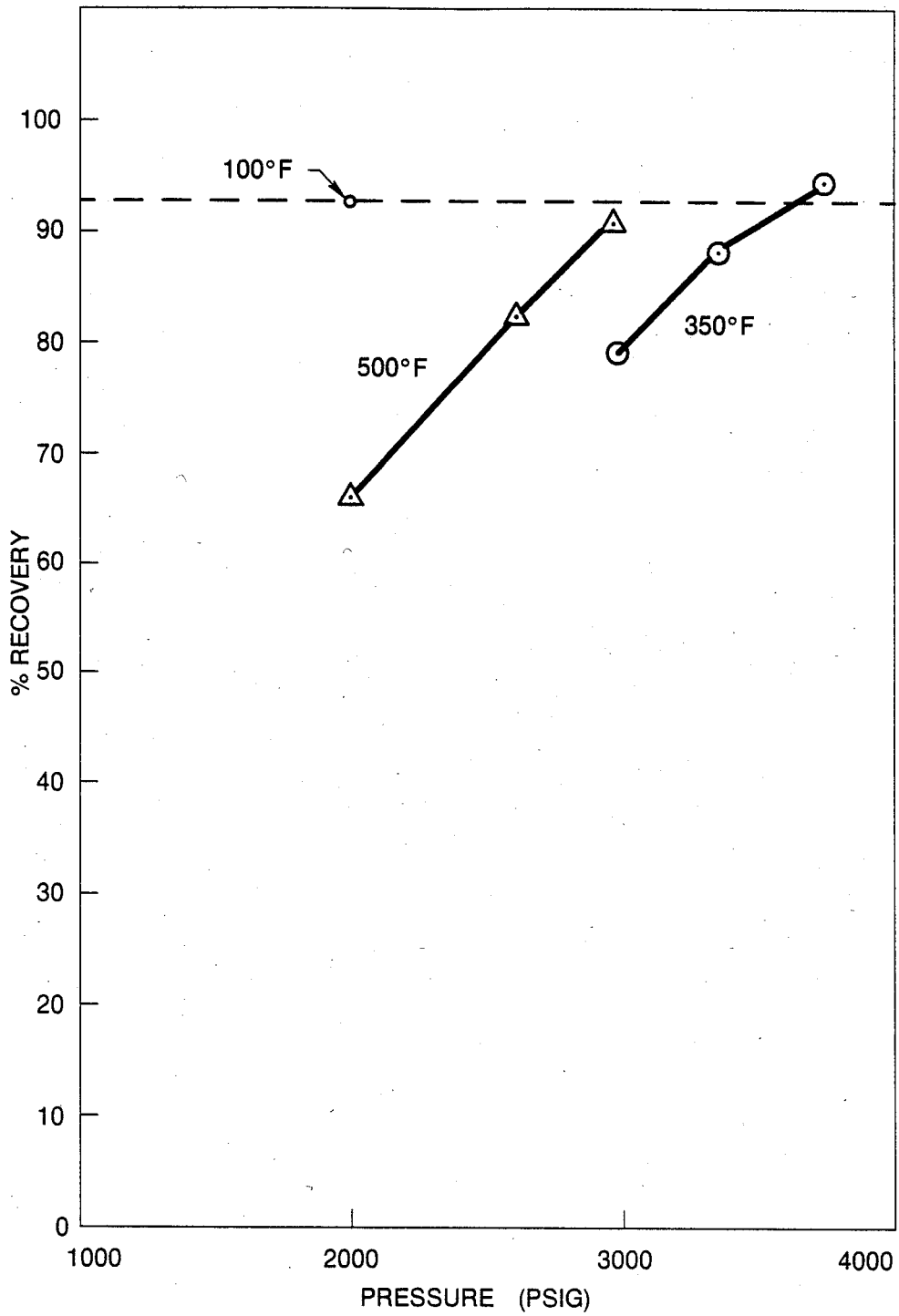
FIG. 4 is a graph representing the results of examples presented herein indicating the generation of miscibility at two different temperatures.
Figure 5:
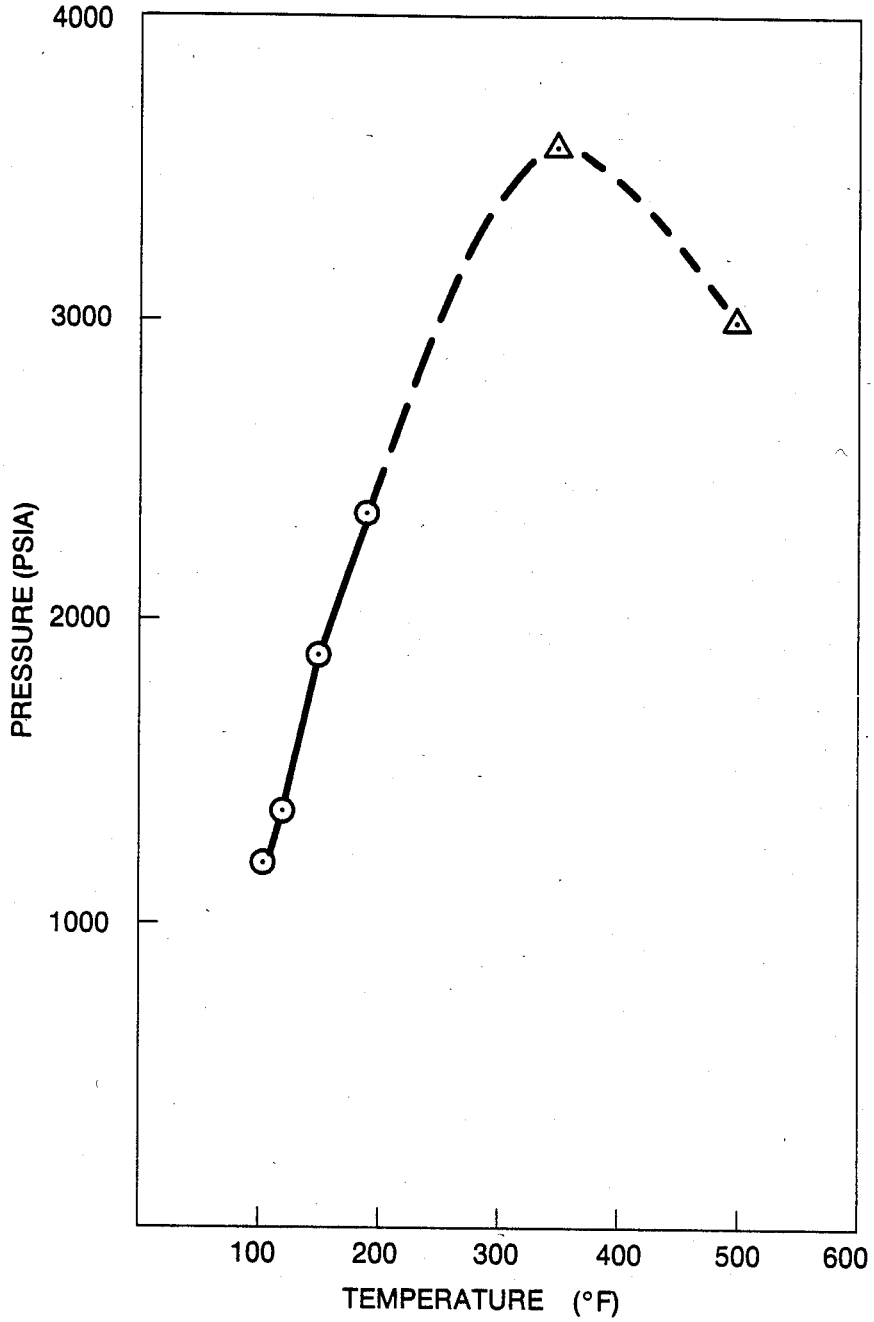
FIG. 5 is a graph similar to that of FIG. 1, illustrating the teachings of the present invention.

FIG. 4 herein illustrates the results of the slim tube tests described above, using Levelland oil and relatively hot temperatures simulating those of a reservoir undergoing a steam flood. The baseline, or that level of displacement which is herein defined as "miscible displacement", is denoted at 100° F. and a pressure of 2000 psig, which is that point wherein 93% recovery of the injected oil is miscibly displaced by $CO_2$, thereby indicating "miscible displacement". For the purposes of these studies the minimum miscibility pressure is defined as the minimum pressure at a given temperature at which this recovery level is achieved. This simplified definition can be used because of the extensive previous work with this oil. (See Yellig, W. F., Carbon Dioxide Displacement of a West Texas Oil, Soc. of Pet. Eng. J., December 1982, p. 805–815.) At a temperature of 350° F., miscible displacement occurs at approximately 3730 psig, and at 500° F. miscible displacement occurs at approximately 2950 psig. Therefore, when one adds this new data to the FIG. 6 of the Yellig and Metcalfe article, one sees that the curve does not extend outwardly and upwardly with ever-increasing reservoir pressures required for miscible displacement at increasing temperatures as previously thought, but, as shown in FIG. 5 herein, the reservoir pressure necessary for miscible displacement begins to decrease with increasing temperature.

Therefore, by injecting a fluid such as $CO_2$, with a hydrocarbon formation-heating fluid such as steam, one can achieve miscible displacement on the "downward" trend of the MMP curves at a pressure substantially below the formation fracture pressure. For this particular reservoir (Levelland) the formation parting pressure is on the order of 3200 psig.

This concept results in two important considerations: (1) one can use $CO_2$ miscible flooding by increasing the temperature in reservoirs where it would otherwise be impossible to achieve miscibility reservoir temperatures, because $CO_2$ miscibility could only be attained at pressures above the fracture pressure of the reservoir at ambient reservoir temperatures (this becomes particularly attractive when $N_2$ miscible flooding is considered), and (2) at the higher temperatures one can *increase* oil recovery in reservoirs undergoing a steam flood by addition of $CO_2$, since recovery due to miscible displacement is appreciably higher than displacement resulting merely from mobilization due to viscosity reduction.

Therefore, as one floods hotter reservoirs with $CO_2$, the pressure required for $CO_2$ miscibility would increase and the oil recovery would decrease because at the higher temperatures miscibility requires higher reservoir pressures. However, if the temperature is high enough, the MMP decreases and oil recovery increases due to the phenomenon noted above. Therefore, even in relatively hot reservoirs, it may be desirable to introduce steam if a $CO_2$ flood is contemplated, in order to operate at lower pressures to increase the oil recovery.

Additionally, a number of fluids which could be used as enhanced oil recovery agents (i.e., $N_2$, flue gas, hydrocarbon gases, $CO_2$) in the method of the present invention are not miscible with reservoir oil at reservoir pressures and temperatures. The use of a heating agent such as steam lowers the fluid MMP to practical reservoir pressures and permits miscible displacement of oil by a fluid which would otherwise be immiscible with the reservoir oil.

The invention is not to be constructed as limited to the particular form described herein since these are to be regarded as illustrative rather than restrictive. The invention is intended to cover all compositions and processes which do not depart from the spirit and scope of the invention.

I claim:

1. A method of recovery of oil from a subterranean oil-bearing reservoir, said reservoir having a predetermined reservoir fracture pressure and a reservoir temperature, comprising:

(a) injecting into said reservoir an oil-recovery fluid, wherein a mixture of said oil recovery fluid and said oil has a minimum miscibility pressure at the ambient reservoir temperature which is higher than the reservoir fracture pressure, (b) injecting steam into said reservoir such that the temperature of said mixture of said oil and said oil recovery fluid is elevated above the ambient reservoir temperature to a temperature at which the minimum miscibility pressure at the elevated temperature is lower than the reservoir fracture pressure and, (c) miscibly displacing said reservoir oil through said reservoir at a pressure below the reservoir fracture pressure.

2. The method as recited in claim 1, wherein said oil recovery fluid may be selected from the group consisting of $CO_2$, nitrogen, hydrocarbon gas, or flue gas.

3. The method as recited in claim 2, wherein steps (a) and (b) are repeated sequentially.

4. The method as recited in claim 1, wherein steps (a) and (b) are repeated sequentially.

5. A method of recovering oil from a subterranean oil-bearing reservoir, said reservoir having a predetermined ambient reservoir temperature and pressure, comprising:

(a) injecting into said reservoir an oil-recovery fluid, wherein a mixture of said oil recovery fluid and said oil has a minimum miscibility pressure at the ambient reservoir temperature which is higher than the reservoir fracture pressure, and (b) injecting into said reservoir a heated second fluid to raise the reservoir temperature to a temperature at which the minimum miscibility pressure at the elevated temperature is lower than the reservoir fracture pressure.

6. The method as recited in claim 5, wherein said oil recovery fluid may be selected from the group consisting of $CO_2$, nitrogen, hydrocarbon gas, or flue gas.

7. The method as recited in claim 5, wherein said heated second fluid comprises steam.

8. The method as recited in claim 3, wherein steps (a) and (b) are repeated sequentially.

9. A method of displacing oil through a subterranean oil-bearing reservoir undergoing an injection of a first fluid, wherein the first fluid will not miscibly displace said oil at a pressure below the ambient fracture pressure of the reservoir and at the ambient reservoir temperature, comprising the additional step of increasing the temperature of at least a portion of said reservoir by the injection of a heated second fluid to a temperature such that the first fluid will miscibly displace said oil at a pressure below the ambient fracture pressure of the reservoir.

10. The method as recited in claim 9, wherein said first fluid is selected from the group consisting of $CO_2$, nitrogen, hydrocarbon gas or flue gas.

11. A method of displacing oil through a subterranean oil-bearing reservoir undergoing a steam flood which increases the reservoir temperature above ambient reservoir temperature, comprising introducing a fluid which will miscibly displace said oil at a pressure below the ambient fracture pressure of the reservoir.

12. The method as recited in claim 11, wherein said fluid is selected from the group consisting of $CO_2$, nitrogen, hydrocarbon gas or flue gas.

* * * * *